US005882768A

United States Patent [19]

Claytor

[11] Patent Number: 5,882,768

[45] Date of Patent: Mar. 16, 1999

[54] BASE STOCK PACKAGING STRUCTURE INCLUDING A COLLOIDAL COPOLYMER FOR INCREASED HOLD-OUT

[75] Inventor: Robinson Camden Perkins Claytor, Covington, Va.

[73] Assignee: Westvaco Corp., New York, N.Y.

[21] Appl. No.: 753,758

[22] Filed: Nov. 29, 1996

Related U.S. Application Data

[63] Continuation of Ser. No. 503,176, Jul. 17, 1995, abandoned.

[51] Int. Cl.[6] ..... B32B 29/04

[52] U.S. Cl. ..... 428/143; 428/452; 428/454; 428/511; 428/537.5; 428/331; 428/332; 428/149; 162/137

[58] Field of Search ..... 428/452, 454, 428/511, 537.5, 331, 332, 143, 149; 162/137

[56] References Cited

U.S. PATENT DOCUMENTS

| | | | |
|---|---|---|---|
| 2,537,114 | 1/1951 | Young et al. | 478/454 |
| 2,685,571 | 8/1954 | Stinchfield et al. | 428/452 |
| 3,298,987 | 1/1967 | Colgan et al. | 162/137 |
| 3,607,348 | 9/1971 | Wray | 117/38 |
| 3,767,439 | 10/1973 | Moyer et al. | 106/210 |
| 3,856,564 | 12/1974 | Kirkham | 117/152 |
| 4,128,263 | 12/1978 | Traxler et al. | 282/27.5 |
| 4,154,899 | 5/1979 | Hershey et al. | 428/537 |
| 4,445,970 | 5/1984 | Post et al. | 162/135 |
| 4,543,280 | 9/1985 | Fujita et al. | 428/35 |
| 5,334,449 | 8/1994 | Bergmann et al. | 428/327 |
| 5,362,573 | 11/1994 | Pandian et al. | 428/511 |

*Primary Examiner*—William P. Watkins III
*Attorney, Agent, or Firm*—J. R. McDaniel; R. L. Schmalz

[57] ABSTRACT

This invention relates to the use of a single "hold-out" coating layer including a colloidal copolymer applied by the paper machine on the press-applied barrier side of a paperboard substrate. Such structures of this type, generally, allow paper machine with only one coater on the barrier side to apply a sufficient coating for the desired hold-out.

5 Claims, 1 Drawing Sheet

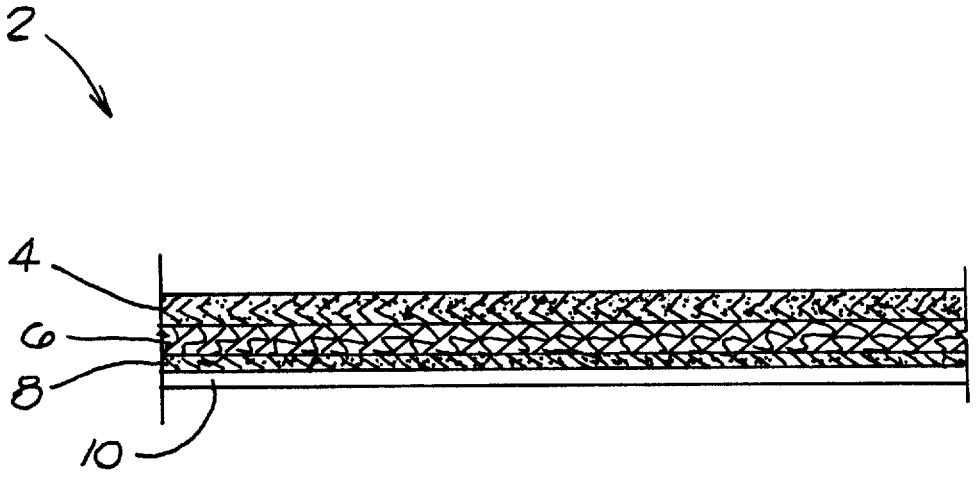
FIG.

BASE STOCK PACKAGING STRUCTURE INCLUDING A COLLOIDAL COPOLYMER FOR INCREASED HOLD-OUT

This application is continuation of application Ser. No. 08/503,176 filed Jul. 17, 1995.

BACKGROUND OF THE INVENTION

1. Field of the Invention

This invention relates to the use of a single "hold-out" coating layer applied by the paper machine on the press-applied. barrier side of a paperboard substrate. Such structures of this type, generally, allow paper machines with only one coater on the barrier side to apply a sufficient coating for the desired hold-out.

2. Description of the Related Art

It is known, in paperboard carton production, to produce a carton with a press-applied coating on the nonclay-coated side. Due to the lack of hold-out, severe pin-holing of the press-applied coating can result. On a clay-coated side, a nearly pin-hole free, press-applied film can be achieved. However, during folding and scoring operations, pin holes may develop in corners and seams and can result in the food product attacking the paperboard layer resulting in catastrophic failure. Also, if a clay-coated surface is required beneath the press-applied film, this may require exterior printing on a non-clay coated side if C1S (coated one side) paperboard is used. This may dramatically reduce the print quality of the package. Consequently, a more advantageous coating, then, would be presented if the hold-out could be improved.

It is also known, in the papermaking industry, to make use of a colloidal copolymer such as styrene-butadiene resin (SBR). The SBR is specifically used as a coating binder in papermaking. Advantages of the SBR are a better gloss, inking, resistance to moisture and a more relaxed and flexible coating. Exemplary of such prior art are U.S. Pat. No. 2,537,114 ('114) to A. E. Young et al., entitled "Pigment Coated Paper" and U.S. Pat. No. 2,685,571 ('571) to J. C. Stinchfield, entitled "Mineral-Coated Paper and Composition Therefor". While the '114 and '571 patents employ the use of a SBR, the SBR is not used to increase the desired hold-out. Consequently, a still further advantageous coating, then, would be presented if the SBR could be used in order to increase the hold-out.

It is apparent from the above that there exists a need in the art for a press-applied polymer layer which can be applied to paperboard cartons and packages, but which at the same time can be used to enhance press-applied barrier hold-out of the board. It is a purpose of this invention to fulfill this and other needs in the art in a manner more apparent to the skilled artisan once given the following disclosure.

SUMMARY OF THE INVENTION

Generally speaking, this invention fulfills these needs big providing a substrate for paperboard packaging, comprising a first layer of particulate minerals, a paperboard layer located interior to the first layer of particulate minerals, a second layer of particulate minerals including a colloidal copolymer for improving holdout located interior to the paperboard layer, and a barrier layer located interior to the second layer of particulate minerals.

In certain preferred embodiments, the colloidal copolymer is styrene-butadiene resin (SBR). Also, the barrier layer is a press-applied barrier layer.

In another further preferred embodiment, the use of the colloidal copolymer in the second layer of particulate minerals enhances the press-applied barrier hold-out properties of the substrate and thus may avoid catastrophic failure in subsequently produced paperboard containers.

The preferred substrate, according to this invention, offers the following advantages: ease of assembly; excellent stability; excellent durability; good economy and excellent hold-out charac-teristics. In fact, in many of the preferred embodiments, these factors of ease of assembly, stability, durability and hold-out are optimized to the extent that is considerably higher than heretofore. achieved in prior, known substrates.

BRIEF DESCRIPTION OF THE DRAWINGS

The above and other features of the present invention, which will become more apparent as the description proceeds, are best understood by considering the following detailed description in conjunction with the accompanying drawing, in which: the single FIGURE is a vertical, cross-sectional view of a coated two-side substrate for press-applied barriers, according to the present invention.

DETAILED DESCRIPTION OF THE INVENTION

With reference to the FIGURE, there is illustrated coated two-side substrate 2. Substrate 2 includes, in part, exterior particulate coating 4, paperboard layer 6, interior particulate coating 8 including a colloidal copolymer, and conventional barrier coating 10. Coating 4, preferably, is constructed of clay or calcium carbonate and is achieved through the conventional coating of one or more layers of particulate mineral upon paperboard layer 6. Paperboard layer 6 is, typically, constructed from a 0.018 inch thick sheet of solid bleached sulfate (SBS), solid unbleached sulfate (SUS) sheet or clay coated newsback (CCNB). The term "paperboard" describes paper within the thickness range of 0.007 to 0.028". The invention is relevant to the full scope of such a range, as applied to packaging and beyond.

During the construction of substrate 2, paperboard layer 6 is conventionally coated with one or more coats of particulate minerals to form exterior layer 4. On the other side of paperboard layer 6, interior coating 8 is formed by adjusting the coating formulation to contain a desired percentage of film-forming binder in order to enhance the hold-out qualities. Styrene-butadiene resin (SBR) may be used at a level of up to 100% of the total binder and in coat weights of 5 to 9 lbs per ream. Differing levels of SBR, different coat weights and the use of other film-forming binders (polyvinyl alcohol) can also be used. This should improve the hold-out qualities of coating layer 8 so that one coat is, typically, sufficient for a press-applied barrier. This also allows paper machines with only one coater on the barrier side to apply a sufficient coating for the desired hold-out. After coating 8 is applied, conventional barrier coating 10 is press-applied according to conventional techniques.

The following Examples are provided to further illustrate this present invention and are not to be construed as limiting the invention in any manner.

Example 1

1. Paperboard layer caliper (thickness): 0.018"
2. First Layer of Particulate Minerals Coat Weights:

-continued

| | |
|---|---|
| first coater: | 3.5 lbs/ream |
| 12% Binder (all Polyvinyl acetate (PVAC)) | |
| second coater: | 6.5 lbs/ream |
| 12% Binder (all PVAC) | |
| 3. Second Layer of Particulate Minerals with colloidal copolymer Coat Weight (Press Applied Barrier Side): | 7.5 lbs/ream |
| 12% binder, 50% of which is SBR, 50% PVAC | |
| 4. Barrier Layer: | 3.0 lbs/ream |

Example 2

| | |
|---|---|
| 1. Paperboard layer caliper (thickness): | 0.014" |
| 2. First Layer of Particulate Minerals Coat Weights: | |
| first coater: | 3.5 lbs/ream |
| 12% Binder (all Polyvinyl acetate (PVAC)) | |
| second coater: | 6.5 lbs/ream |
| 12% Binder (all PVAC) | |
| 3. Second Layer of Particulate Minerals with colloidal copolymer Coat Weight (Press Applied Barrier Side): | 7.5 lbs/ream |
| 12% binder, 50% of which is SBR, 50% PVAC | |
| 4. Barrier Layer: | 3.0 lbs/ream |

Once given the above disclosure, many other features, modifications or improvements will become more apparent to the skilled artisan. Such features, modifications or improvements are, therefore, considered to be a part of this invention, the scope of which is to be determined by the following claims.

What is claimed is:

1. A composite structure for paperboard packaging for increasing hold-out, wherein said structure is consisting essentially of:

a first layer of particulate minerals;

a paperboard layer located interior to said first layer of particulate minerals;

a second layer of particulate minerals including a binder comprised of polyvinyl acetate and a colloidal copolymer for increasing hold-out located interior to said paperboard layer wherein said colloidal copolymer is further comprised of a styrene-butadiene resin , said binder includes up to 50% by weight of said colloidal copolymer, and wherein said second layer is applied with a coat weight of 5 to 9 pounds per ream and applied by a paper machine; and a press-applied barrier layer located interior to said second layer of particulate minerals.

2. The structure, as in claim 1, wherein said first layer of particulate minerals is further comprised of:

clay.

3. The structure, as in claim 1, wherein said first layer of particulate minerals is further comprised of:

calcium carbonate.

4. The structure, as in claim 1, wherein said second layer of particulate minerals is further comprised of:

clay.

5. The structure, as in claim 1, wherein said second layer of particulate minerals is further comprised of:

calcium carbonate.

* * * * *